US009456663B1

(12) United States Patent
Wheeler et al.

(10) Patent No.: US 9,456,663 B1
(45) Date of Patent: Oct. 4, 2016

(54) CHILD-PROOF LOCKING SYSTEM

(71) Applicant: RODAWG LLC, Miami, FL (US)

(72) Inventors: Jasper E. Wheeler, Brooklyn, NY (US); Jordan Diatio, Brooklyn, NY (US)

(73) Assignee: RODAWG HOLDINGS LLC, Miami, FL (US)

( * ) Notice: Subject to any disclaimer, the term of this patent is extended or adjusted under 35 U.S.C. 154(b) by 0 days.

(21) Appl. No.: 14/661,916

(22) Filed: Mar. 18, 2015

Related U.S. Application Data

(60) Provisional application No. 61/954,957, filed on Mar. 18, 2014.

(51) Int. Cl.

| | |
|---|---|
| ***A44B 19/00*** | (2006.01) |
| ***A44B 19/30*** | (2006.01) |
| ***A44B 19/26*** | (2006.01) |
| ***B65D 33/25*** | (2006.01) |
| ***B65D 50/04*** | (2006.01) |

(52) U.S. Cl.
CPC ..... *A44B 19/301* (2013.01); *A44B 19/262* (2013.01); *B65D 33/2591* (2013.01); *B65D 50/045* (2013.01)

(58) Field of Classification Search
CPC ..... B65D 33/2591; Y10T 24/2561; Y10T 24/2588; A44B 19/28; A44B 19/267
USPC ..... 383/61.2, 63–65; 24/430, 415, 399, 24/400, 387, 436
See application file for complete search history.

(56) References Cited

U.S. PATENT DOCUMENTS

| | | | | |
|---|---|---|---|---|
| 4,890,935 | A | 1/1990 | Ausnit | |
| 5,189,764 | A * | 3/1993 | Herrington | A44B 19/30 24/384 |
| 5,681,115 | A * | 10/1997 | Diederich | A44B 19/301 190/120 |
| 5,851,070 | A | 12/1998 | Dobreski | |
| 6,071,011 | A | 6/2000 | Thomas | |
| 6,286,999 | B1 * | 9/2001 | Cappel | B65D 33/065 24/400 |
| 6,293,701 | B1 | 9/2001 | Tomic | |
| 6,360,411 | B1 * | 3/2002 | Bortz | G09F 3/0311 24/625 |
| 6,385,818 | B1 * | 5/2002 | Savicki, Sr. | B65D 33/2591 24/30.5 R |
| 6,431,754 | B1 * | 8/2002 | Savicki, Sr. | A44B 19/267 156/73.1 |
| 6,490,769 | B2 * | 12/2002 | Siegel | B65D 33/2591 24/387 |
| 6,533,335 | B2 * | 3/2003 | Hudson | A44B 19/301 190/903 |
| 7,008,106 | B2 | 3/2006 | Cappel | |
| 7,073,233 | B2 * | 7/2006 | Leva | A44B 19/26 24/386 |
| 7,269,883 | B2 * | 9/2007 | Savicki | A44B 19/267 24/399 |
| 7,377,015 | B2 | 5/2008 | Long | |
| 7,506,416 | B2 * | 3/2009 | Hoffman | A44B 19/267 24/399 |
| 7,665,192 | B2 | 2/2010 | Blythe | |
| 7,670,052 | B2 | 3/2010 | Chaturvedi | |
| 7,904,996 | B2 | 3/2011 | Dobreski | |
| 8,893,356 | B2 * | 11/2014 | Ozaki | B65D 33/2591 24/415 |
| 9,126,724 | B2 * | 9/2015 | VanLoocke | B65D 33/2591 |

* cited by examiner

*Primary Examiner* — Peter Helvey
(74) *Attorney, Agent, or Firm* — Seth Natter; Natter & Natter

(57) ABSTRACT

A child-proof locking system for a slide fastener includes a slide which engages a pair of molded plastic interlocking strips. The slide is carried in a puller having a proximal grip and a distal latch. When the slide fastener is closed, the puller seats in a strike, with the latch having a plurality of arms abutting a distal end of the strike to lock the puller. To open the slide fastener, the latch arms are pressed inwardly with one hand, to clear the strike, while the grip is pulled away from the strike with the other hand.

18 Claims, 8 Drawing Sheets

CHILD-PROOF LOCKING SYSTEM

RELATED APPLICATION

This application claims the benefit of U.S. Provisional Application No. 61/954,956 filed Mar. 18, 2014, the entirety of which are incorporated herein by reference.

BACKGROUND OF THE INVENTION

1. Field of the Invention

The present invention relates generally to containers and more particularly to a slide fastener locking system for guarding against unauthorized access by children.

2. Antecedents of the Invention

Flexible bags or pouches having slide closures, fasteners or zippers, such as those sold under the registered trademark ZIPLOK® have been employed by consumers who would fill and refill the bags. At locations where children were present, it was not advisable to store potentially hazardous items, such as medications, in flexible bags because young children could easily open the slide fasteners and access the contents. A need has been perceived for flexible bags with child-proof slide fasteners.

Child-proof closures for medicines have been employed and pharmacies generally dispense medications in bottles with child-proof caps.

One attempt at providing a flexible bag a with child-proof slide fastener was disclosed in U.S. Pat. No. 7,670,052 wherein a slider was not capable of separating an interlocked zipper track unless a plow on the top surface of the slider was depressed downwardly. While some degree of difficulty was presented, the slide fastener was susceptible to being opened with one hand with relative ease. One need only depress the plow with one's index finger, grip the slider between one's middle finger and thumb and then pull the slider.

A further attempt has been disclosed in U.S. Pat. No. 5,681,115 wherein a releasable clamp which included a pair of arms was fixed to a flexible bag at the end of a slide fastener track. The arms engaged a metal slider while an aperture of a slider pull tab was engaged over a boss formed in the clamp. Opening the slide fastener required the use of a separate tool or implement, such as, coin to disengage the pull tab from the boss and then required squeezing the arms to release the slider.

While a degree of dexterity required for opening the slide fastener, it should be appreciated that accessing the contents of the bag required the use of a tool or implement, which might not be readily available and thus, an adult attempting to access the bag contents could be frustrated and precluded.

SUMMARY OF THE INVENTION

A child-proof locking system for a slide fastener includes a slide having a generally "V" shaped passage which engages a pair of molded plastic interlocking strips. The slide is carried in a puller having a latch which includes unitary spring loaded latch arms. When the slide fastener is closed, the puller seats in a strike, with the latch arms sprung outwardly, abutting a distal end of the strike to lock the slide. To open the slide fastener, the latch arms must be pressed inwardly with one hand, to clear the strike, while the puller is simultaneously pulled away from the strike with the other hand.

From the foregoing compendium, it will be appreciated that an aspect of the present invention is to provide a child-proof locking system for a slide fastener of the general character described which is not subject to the foregoing disadvantages of the antecedents of the invention.

A feature of the present invention is to provide a child-proof locking system for a slide fastener of the general character described which is easy to use.

A consideration of the present invention is to provide a child-proof locking system for a slide fastener of the general character described which is well suited for applications wherein children are frequently encountered.

A further aspect of the present invention is to provide a child-proof locking system for a slide fastener of the general character described which is well suited for economical mass production fabrication.

A further consideration of the present invention is to provide a child-proof locking system for a slide fastener of the general character described well suited for securing the contents of flexible bags against unintended access by children.

Another aspect of the present invention is to provide a child-proof locking system for a slide fastener of the general character described which requires simultaneous manipulation with two hands in order to open the slide fastener.

A further feature of the present invention is to provide a child-proof locking system for a slide fastener of the general character described with simplified access for adults without requiring keys, tools or other implements.

An additional aspect of the present invention is to provide a flexible bag having child-proof locking system of the general character described wherein the bag may be manually opened without the requirement for employing keys, tools or other implements.

Yet another consideration of the present invention is to provide a flexible bag having a child-proof locking system of the general character described which is well suited for applications wherein children are frequently encountered.

A still further aspect of the present invention is to provide a flexible bag having child-proof locking system of the general character described which is easy to use.

A still further aspect of the present invention is to provide a flexible bag having a child-proof locking system of the general character described which is well suited for economical mass production fabrication.

To provide a flexible bag having a child-proof locking system of the general character described which required simultaneous manipulation with two hands in order to open the slide fastener is yet another consideration of the present invention.

A further aspect of the present invention is to provide a flexible bag having a child-proof locking system of the general character described with simplified access for adults.

A further feature of the present invention is to provide a method of securing flexible bag having a slide fastener against unintended access by children.

Other aspects, features and considerations of the present invention in part will obvious and in part will be pointed out hereinafter.

With these ends in view, the invention finds embodiment in certain combinations of elements, arrangements of parts and series of steps by which the aforesaid aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which are shown one of the various possible exemplary embodiments of the invention.

DESCRIPTION OF THE PREFERRED EMBODIMENT

Figure 1:
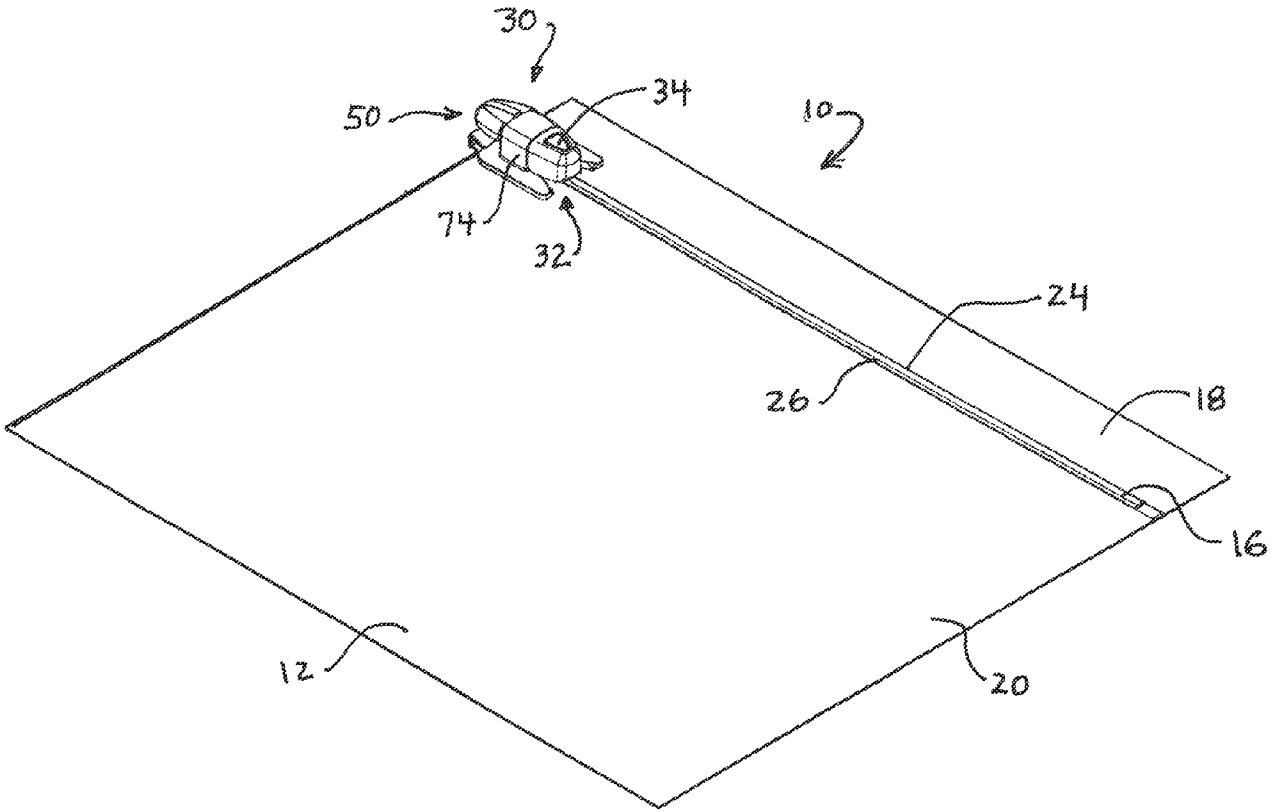
FIG. 1 is an isometric view of a flexible bag having a slide fastener with a child-proof locking system constructed in accordance with the invention and illustrating the slide fastener in a closed locked position.

Referring now in detail to the drawings, the reference numeral 10 denotes generally a flexible pouch or bag comprised of a tear resistant film or sheet, such as, polyolefin film, fiber reinforced polymer, or other tear resistant sheet material, such as that employed in tear-proof envelopes sold under the registered trademark TYVEK®. By way of example, the pouch or bag 10 may be generally quadrilateral in shape, having parallel top and bottom peripheral edges as well as parallel side peripheral edges and may comprise a front panel 12 and a rear panel 14 which may be joined along common peripheral edges by a heat seal or other bond or by a fold line whereby the panels 12, 14 are formed from a single folded sheet. It should be appreciated that any geometric bag shape, e.g., polygon, round, elliptical, oval, teardrop, etc., will be suitable for implementation with the present invention.

An access opening 16 divides the front panel 12 into an upper portion 18 and a lower portion 20. It should be understood that the access opening could be provided along a peripheral edge, such as the top edge. A slide fastener 22 comprising an elongate flexible plastic upper strip 24 and an elongate flexible plastic lower strip 26 are bonded to the upper and lower edges, respectively of the opening 16. When joined together, the strips 24, 26 interlock with one another to seal the opening 16 as will be described hereinafter, in a manner similar to the slide fastener strips employed in conjunction with resealable flexible bags sold under the registered trademark ZIPLOK® or as illustrated in U.S. Pat. No. 5,681,115, the entirety of which is incorporated by reference Pursuant to the invention, a child-proof locking system 30 is employed to assure that young children are unable to open a sealed bag 10 and access the stored contents. With reference now to FIGS. 4, 7, 8 and 9, it will be seen that a unitary one piece molded plastic puller 32 carries a slide 34 within a hollow socket 36. The slide 34 includes a head 38 and a neck 40 which interconnects the head to a strip engaging base 42 having a "V" shaped channel 44. One of the strips 24, 26 is received in each portion of the "V" shaped channel. Translational movement of the slide 34 in a distal direction, i.e., toward a closed end of the fastener, serves to interlock those portions of the strips 24, 26 positioned to the right of the slide 34 in interlocking engagement, while movement to the right, i.e., in a proximal direction toward an open or proximal end of the fastener, serves to separate those portions of the strips 24, 26 positioned to the left of the slide 34.

The slide socket 36 is seated and fixed within a grip 46 at a proximal end of the puller 32. From the grip 46, the puller extends distally through a reduced thickness transition portion 48 which leads to a latch 50 having a fluke configuration including a pair of coplanar side latch arms 52, 54 and a top latch arm 56 which lies in a perpendicular plane.

A flexible strut 58 extends along a longitudinal axis (8-8) of the one piece puller 32 from the grip 46 to the latch 50. The latch arms 52, 54 and 56 project toward the grip 46 from a rounded distal end 60 of the strut 58.

The transition portion 48 includes a pair of side panels 62, 64 extending from the grip 46 toward the latch 50. Leg extensions 66, 68 of the side panels 62, 64, respectively extend from notched zones 70, 72 of each panel into a space between each side latch arm 52, 54 and the strut 58.

Figure 2:
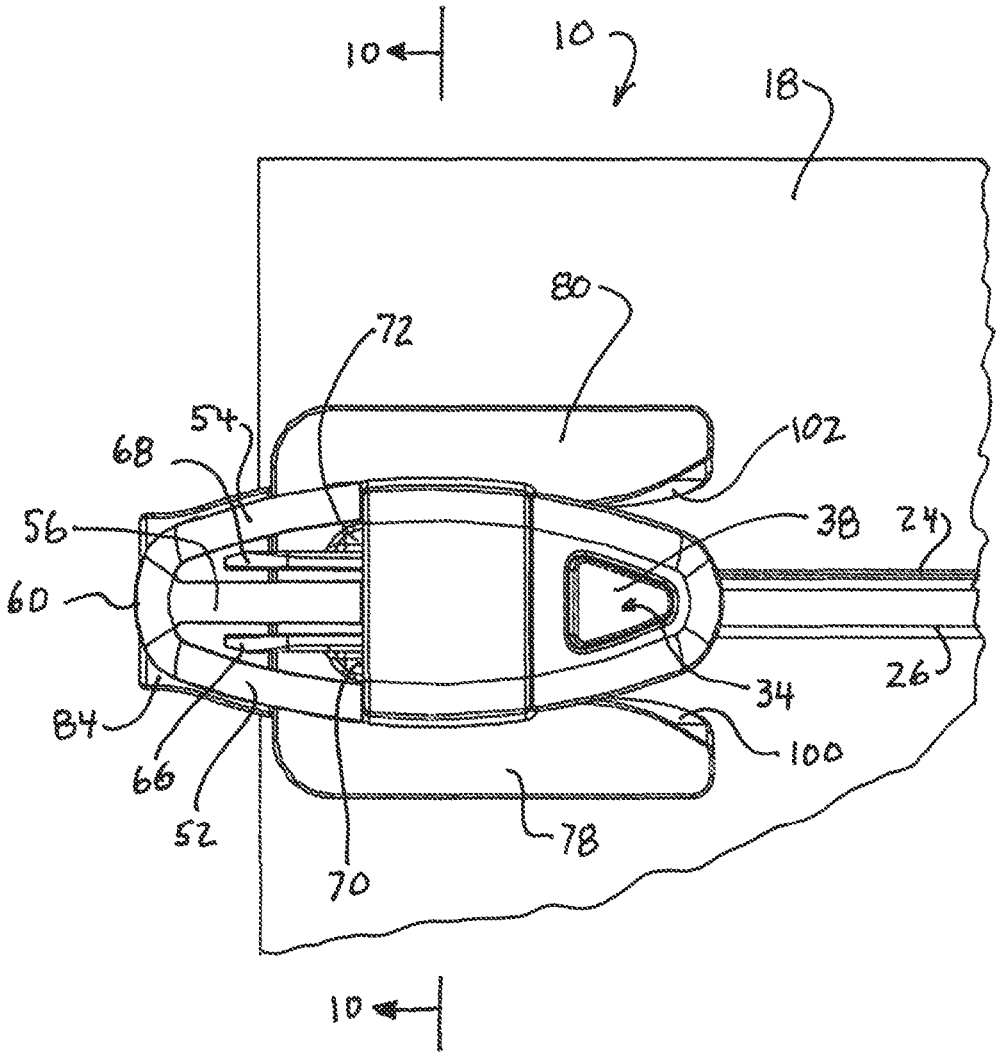
FIG. 2 is an enlarged scale fragmentary front elevational view of the bag and illustrating a strike fixed to the bag at a distal closed end of the fastener and a slide puller locked in passage of the strike, with latch arms of the puller engaging the strike and preventing withdrawal of the puller from the strike passage.
Figure 3:
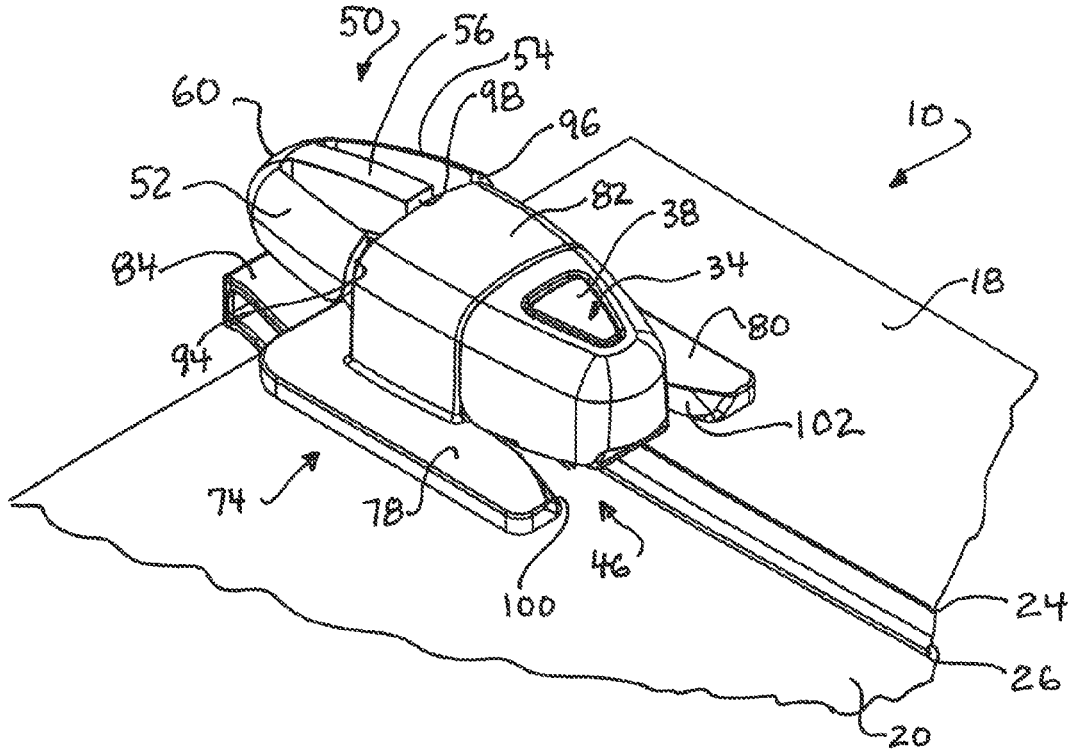
FIG. 3 is an enlarged scale fragmentary isometric view of the bag portion illustrated in FIG. 2.

With reference to FIGS. 1-3, it will be noted that when the access opening 16 is closed, the puller 32 is seated in a strike 74, having a configuration similar to that of a tube strap. More specifically, the strike 74 includes a "U" shaped base 76 having a pair of legs 78, 80. An arch 82 spans across the legs 78, 80, with the interior space or passage defined by the arch 82 being dimensioned to snugly receive the side panels 62, 64 of the of the puller 32.

Figure 6:
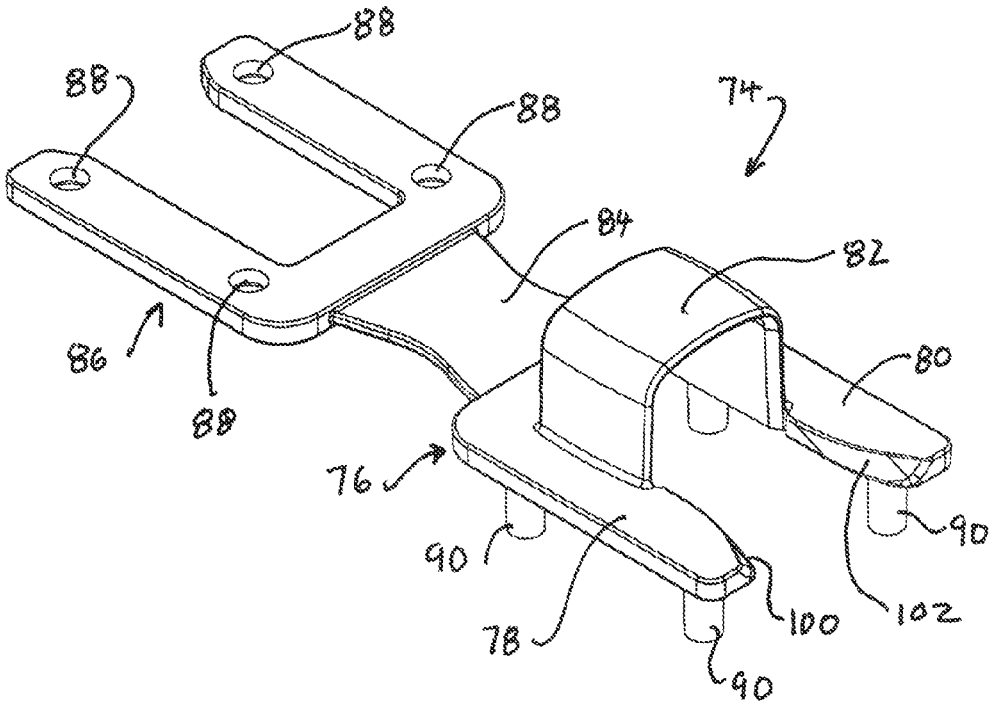
FIG. 6 is an enlarged scale isometric view of the strike prior to being mounted to the flexible bag.
Figure 7:
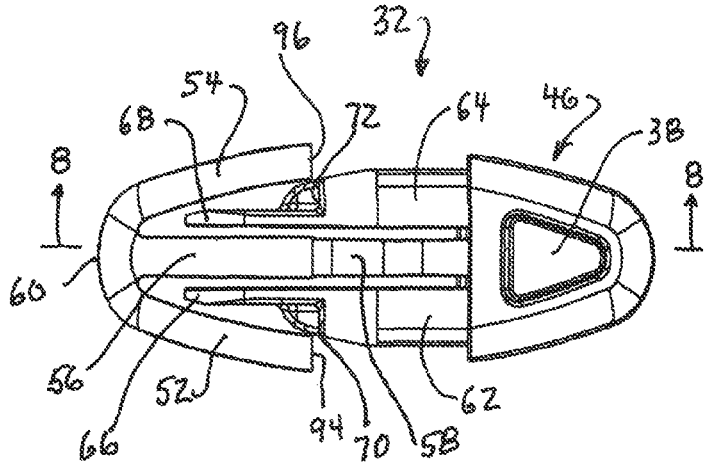
FIG. 7 is an enlarged scale top plan view of the puller and slide.
Figure 8:
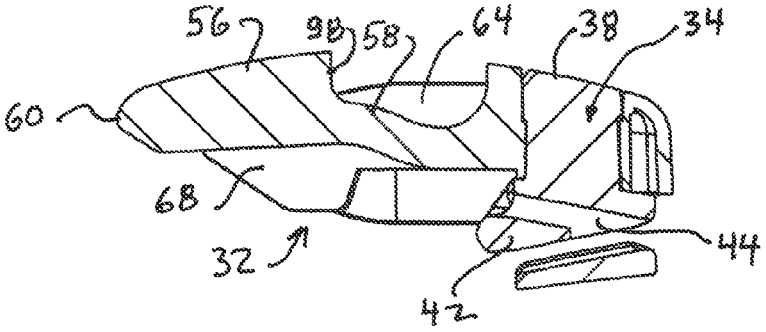
FIG. 8 is a sectional view through the puller and slide, the same being taken substantially along the line 8-8 of FIG. 7.
Figure 9:
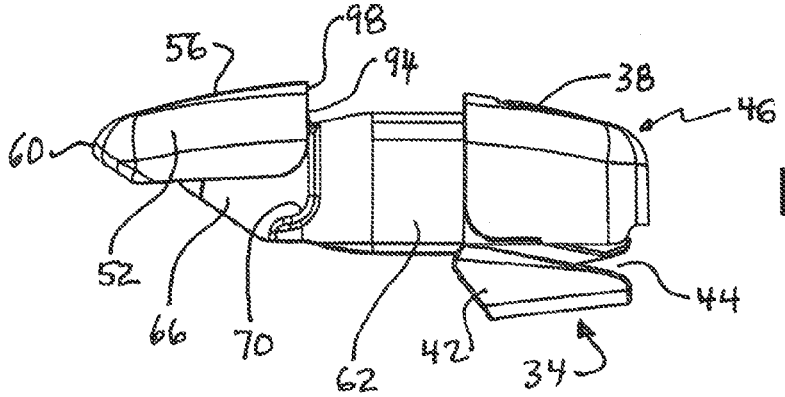
FIG. 9 is side elevational view of the puller and slide.
Figure 10:
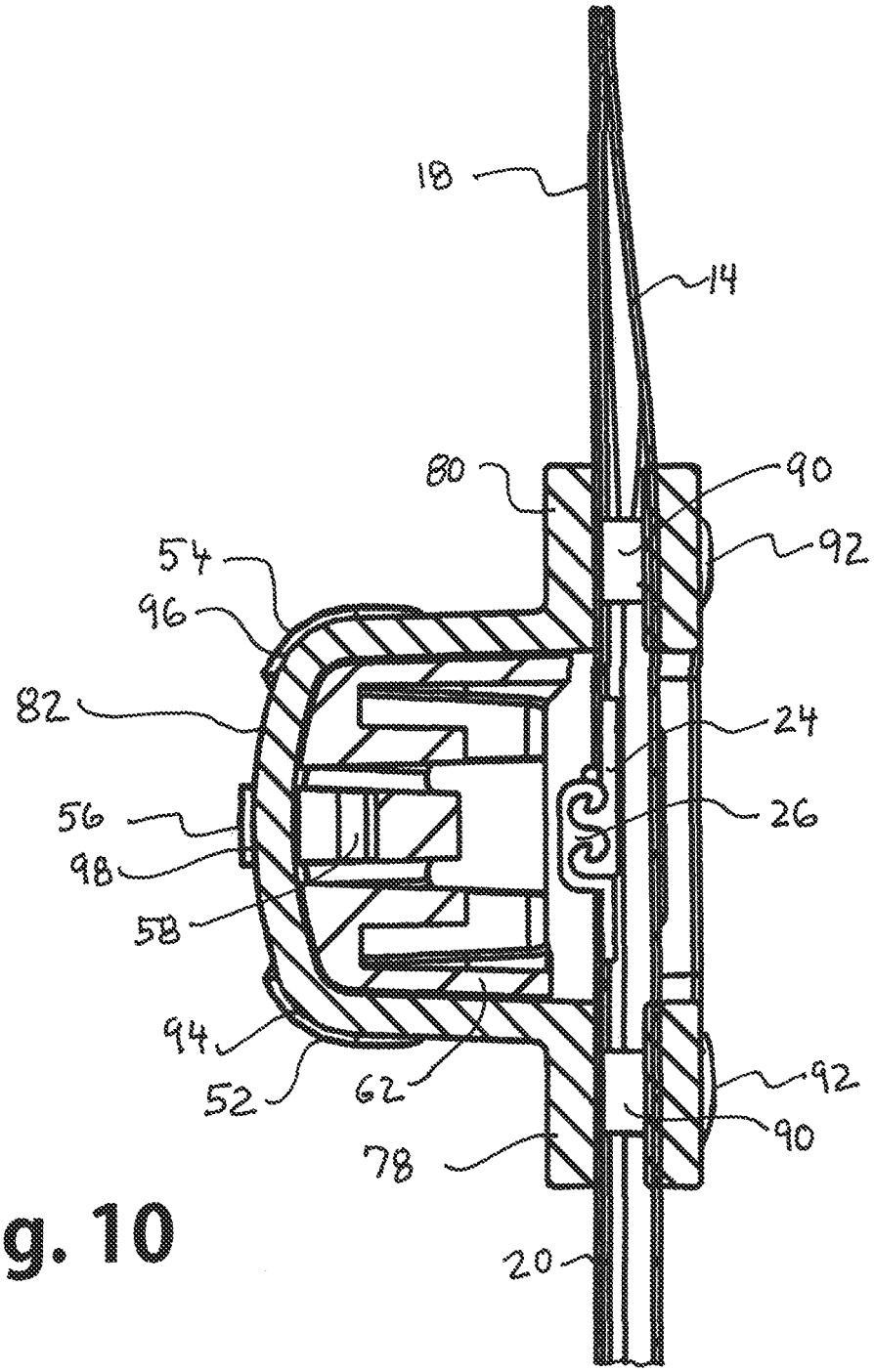
FIG. 10 is an enlarged scale fragmentary sectional view through the bag, the strike and the puller, the same being taken substantially along the line 10-10 of FIG. 2

With reference to FIG. 6, which illustrates to strike 74 in its as molded shape, it should be noted that the a web 84 joins the base 76 to an anchor base 86 having a pair of legs mating with those of the base 76. The anchor base legs include apertures 88 into which studs 90, projecting from the legs 78, 80, are received, after passing through registered apertures formed in the front and rear panels 12, 14 of the bag 10 when the anchor base is folded about the web 84. The end portions 92 of the studs extending beyond the thickness of the anchor base are then heat peened to prevent dislodgement.

In accordance with the invention, the side latch arms 52, 54 each terminate at a planar latch stop 94, 96 which is perpendicular to the longitudinal axis 8-8 of the puller 32. Similarly, the top latch arm 56 terminates at a planar latch stop 98, with all latch stops being coplanar.

Figure 4:
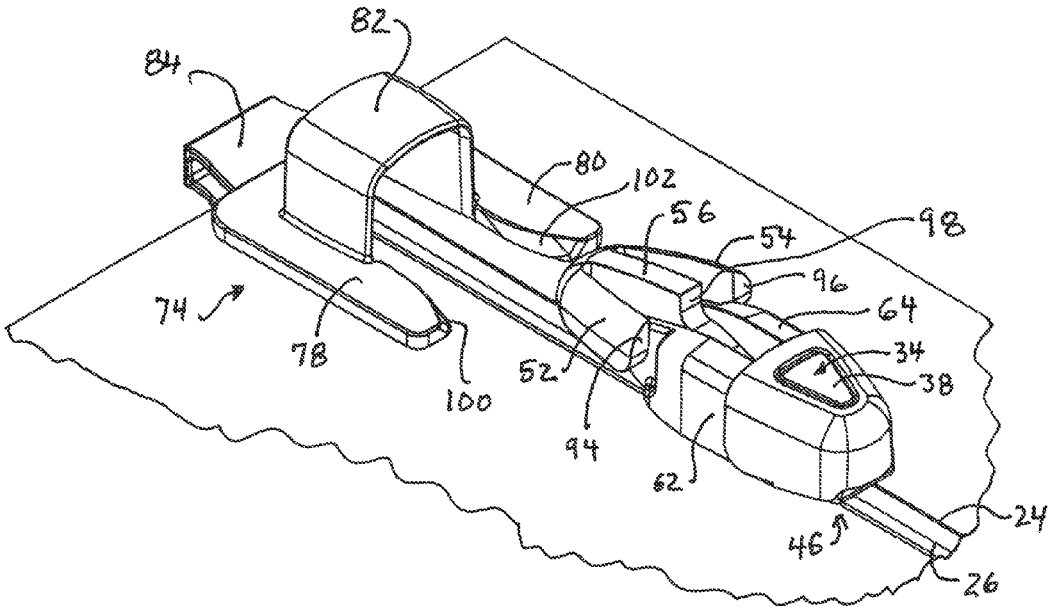
FIG. 4 is an enlarged scale fragmentary isometric view of the bag, similar to FIG. 3 but showing the slide puller separated from the strike.
Figure 5:
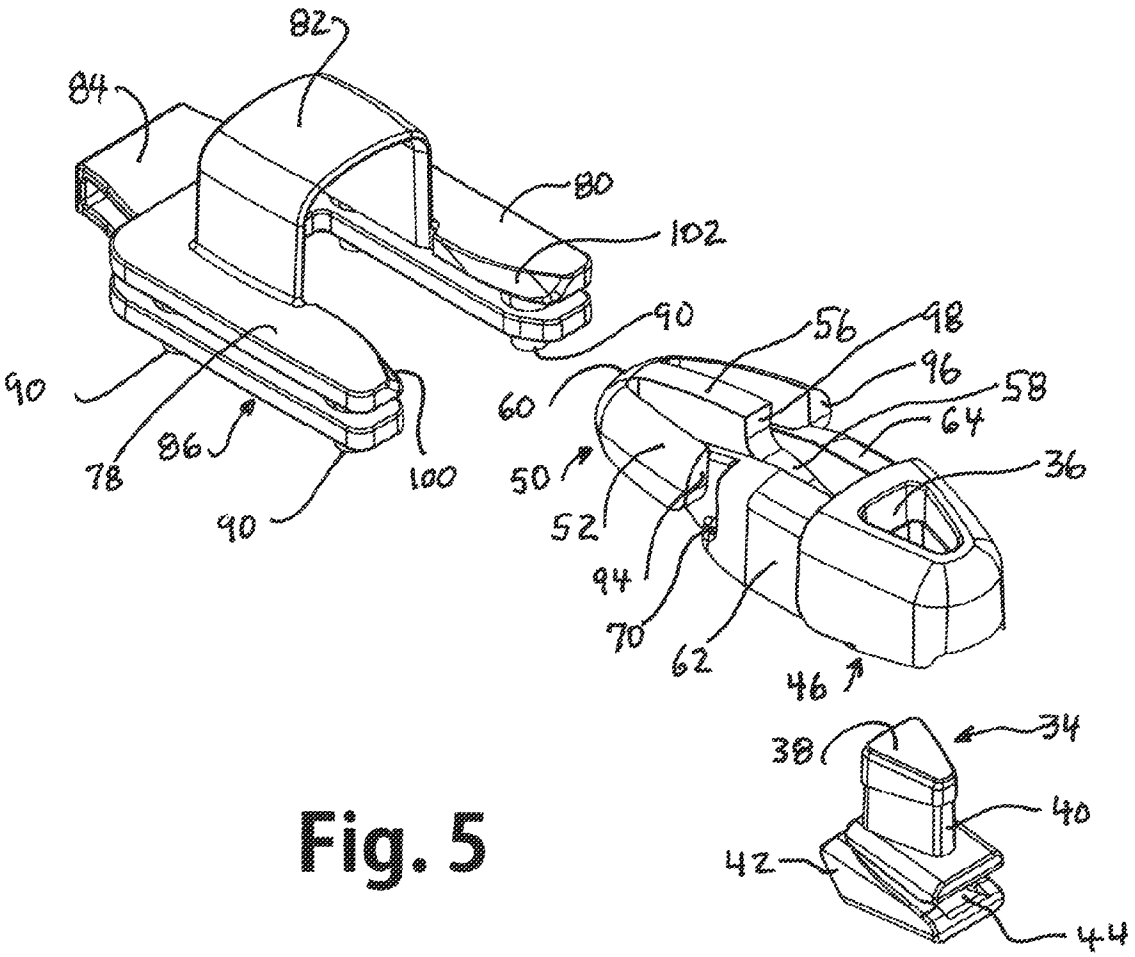
FIG. 5 is an enlarged scale exploded isometric view of the slide puller, the strike and a slide which is carried in and fixed to the puller.

With reference now to FIG. 4, to fully close the access opening 16 and prevent the puller 32 from being actuated by a young child, one would move the puller 32 distally toward the strike 74. Initially, the smooth curved exposed external surfaces of the latch arms 52, 54, 56 will engage a proximal edge of the arch 82 and the arms 52, 54, 56 will deflect inwardly as the transition portion 48 enters the arch passage. Tapered surfaces 100, 102 of the legs 78, 80 may also engage the arms 52, 54 and assist in deflecting the arms 52, 54 inwardly. When the transition portion 48 fully seats within the arch passage, the latch arms 52, 54, 56 are free of restraint and spring open, to their unstressed positions, wherein their outer peripheral surfaces extend to at least the outer peripheral surface of the arch 82 and preferably beyond, as shown in FIG. 4.

As such, the puller 32 cannot be pulled in a proximal direction to open the bag without squeezing the arms 52, 54 toward one another between, for example, a thumb and middle finger while depressing the latch 56 downwardly with an index finger of one hand, while at the same time moving the puller 32 away from the strike 74, with one's other hand. The skill level required to perform such task would be beyond that of a young child without requiring keys, tools or implements.

In the Figures of this application, in some instances, a plurality of elements may be shown as illustrative of a particular element, and a single element may be shown as illustrative of a plurality of a particular elements. Showing a plurality of a particular element is not intended to imply that a system or method implemented in accordance with the invention must comprise more than one of that element or step, nor is it intended by illustrating a single element that the invention is limited to embodiments having only a single one of that respective element. Those skilled in the art will recognize that the numbers of a particular element shown in a drawing can, in at least some instances, be selected to accommodate the particular user needs.

The particular combinations of elements and features in the above-detailed embodiments are exemplary only; the interchanging and substitution of these teachings with other teachings in this and the incorporated-by-reference patents and applications are also expressly contemplated. As those skilled in the art will recognize, variations, modifications, and other implementations of what is described herein can occur to those of ordinary skill in the art without departing from the spirit and the scope of the invention as claimed.

Further, in describing the invention and in illustrating embodiments of the invention in the figures, specific terminology, numbers, dimensions, materials, etc., are used for the sake of clarity. However the invention is not limited to the specific terms, numbers, dimensions, materials, etc. so selected, and each specific term, number, dimension, material, etc., at least includes all technical and functional equivalents that operate in a similar manner to accomplish a similar purpose. For example, the operative components could be reversed, with the slide being fixed to the strike and the puller fixed at the closed end of the fastener.

Use of a given word, phrase, number, dimension, material, language terminology, product brand, etc. is intended to include all grammatical, literal, scientific, technical, and functional equivalents. The terminology used herein is for the purpose of description and not limitation.

Having described a preferred embodiment of the invention, it will now become apparent to one of ordinary skill in the art that other embodiments incorporating their concepts may be used. Moreover, those of ordinary skill in the art will appreciate that the embodiments of the invention described herein can be modified to accommodate and/or comply with changes and improvements in the applicable technology and standards referred to herein. For example, the technology can be implemented in many other, different, forms, and in many different environments, and the technology disclosed herein can be used in combination with other technologies.

Variations, modifications, and other implementations of what is described herein can occur to those of ordinary skill in the art without departing from the spirit and the scope of the invention as claimed. It is felt therefore that these embodiments should not be limited to disclosed embodiments but rather should be limited only by the spirit and scope of the appended claims.

Thus is will be seen that there is provided a child-proof locking system for a slide fastener as well as a flexible bag having a child-proof locking system which achieve the various aspects, features and considerations of the present invention and which is well suited to meet the conditions of practical usage.

Having thus described the invention, there is claimed as new and desired to be secured by Letters Patent:

1. A child-proof locking system for a slide fastener, the slide fastener comprising a pair of interlockable flexible plastic strips, a slide engaging each strip, the slide being movable between an open position at one end of the fastener, wherein the strips are separated, to a closed position at an other end of the fastener, wherein the strips are interlocked, the system including a puller and a strike, the slide being fixed to the puller, the strike being fixed at the other end of the fastener, the strike including a passage, the passage receiving at least a transition portion of the puller when the slide is in the closed position, the puller including a latch, the latch extending beyond the passage toward the other end of the fastener, the latch including a pair of coplanar arms and an arm which deflects along a plane perpendicular to the coplanar arms, each arm including a stop, the stops being in engagement with an edge of the strike to prevent the puller from moving toward the one end of the fastener, the arms being deflectable to positions wherein the stops disengage the edge of the strike, whereby the coplanar arms may be deflected by being compressed between one's thumb and middle finger while the arm which deflects along the perpendicular plane is simultaneously depressed by an index finger of the same hand to withdraw the puller from the strike and move the slide to the open position.

2. A child-proof locking system for a slide fastener in accordance with claim 1 wherein the puller includes a grip, the transition portion being positioned between the grip and the latch, the transition portion having transverse dimensions less than those of the grip and the latch such that the transition portion seats within the passage.

3. A child-proof locking system for a slide fastener in accordance with claim 1 wherein the strike comprises an arch, the passage being defined by the arch.

4. A child-proof locking system for a slide fastener in accordance with claim 1 wherein the latch comprises a smooth tapered exterior surface which engages the passage to deflect the arms inwardly, such that the latch arms enter and pass through the passage when the puller moves the slide toward the other end of the fastener.

5. A child-proof locking system for a slide fastener in accordance with claim 1 further including a flexible bag formed of tear resistant material, the bag having an access opening defined by a pair of edges, one of the flexible strips being affixed to one edge and an other flexible strip being affixed to the other edge.

6. A child-proof locking system for a slide fastener in accordance with claim 5 wherein the flexible bag comprises two panels, the strike comprising an arch and a base, the base including a pair of legs, the legs having mounting studs, the panels having apertures registered with and receiving the mounting studs for securing the strike to the bag.

7. A child-proof locking system for a slide fastener in accordance with claim 6, the strike further including an anchor base, a web joining the anchor base and the base, the base abutting one of the panels and the anchor base abutting the other panel with the mounting studs extending through apertures in the anchor base.

8. A child-proof locking system for a slide fastener in accordance with claim 5 wherein the strike comprises an arch and a base, the base including a pair of coplanar legs, the legs having leading edges with inwardly tapered surfaces, the latch comprising a smooth tapered exterior surface which engages the inwardly tapered leg surfaces to deflect the arms inwardly, such that the latch arms enter and pass through the passage when the slide is moved toward the other end of the fastener.

9. A child-proof locking system for a slide fastener in accordance with claim 4 wherein the strike comprises an arch and a base, the base including a pair of coplanar legs, the legs having leading edges with inwardly tapered surfaces, the coplanar arms comprising smooth tapered exterior surfaces which engage the inwardly tapered leg surfaces to deflect the coplanar arms inwardly, such that the coplanar arms enter and pass through the passage when the slide is moved toward the other end of the fastener.

10. A child-proof flexible bag formed of tear resistant film, the bag having an access opening defined by a pair of edges, the bag further including a slide fastener, the slide fastener comprising an interlockable flexible plastic strip affixed to each edge, a slide, the slide being movable between an open position, at one end of the fastener, wherein the strips are separated, to a closed position, at an other end of the fastener, wherein the strips are interlocked, the bag further including a puller and a strike, the slide being formed of one piece construction including a base engaging each strip and a neck projecting from the base, the puller including a socket, the neck being fixed within the socket formed in the puller for unitary movement of the puller and the slide, the strike being fixed at the other end of the fastener, at least a portion of the puller being engaged in the strike when the slide is in the closed position, the puller further including a latch, the latch engaging the strike when the slide is in the closed position for preventing the portion of the puller from being disengaged from the strike.

11. A child-proof flexible bag formed of tear resistant film in accordance with claim 10 wherein the latch includes a plurality of arms, each arm including a stop, the stops being in engagement with an edge of the strike to prevent the puller from being disengaged from the strike.

12. A child-proof flexible bag formed of tear resistant film in accordance with claim 10 wherein the puller is formed of one piece molded plastic construction.

13. A child-proof locking system for a slide fastener, the slide fastener comprising a pair of interlockable flexible plastic strips, a slide engaging each strip, the slide being movable between an open position at one end of the fastener, wherein the strips are separated, to a closed position, at an other end of the fastener, wherein the strips are interlocked, the system including a pair of elements, the slide being fixed to one of the elements, the other element being fixed at the other end of the fastener, a first element including a passage, the passage receiving at least a portion of the second element when the slide is in the closed position, the second element including a latch, the latch including a pair of coplanar arms and an arm which deflects along a plane perpendicular to the coplanar arms, each arm including a stop, the stops being in engagement with an edge of the first element to prevent the second element from moving relative to the first element, the arms being deflectable such that the stops disengage the edge of the second element, whereby the coplanar arms may be deflected by being compressed between one's thumb and middle finger while the arm which deflects along the perpendicular plane is simultaneously depressed by an index finger of the same hand so that the first element and the second element can be separated and the slide moved to the open position.

14. A child-proof locking system for a slide fastener in accordance with claim 13 wherein the first element comprises an arch and the passage is defined by the arch.

15. A child-proof locking system for a slide fastener in accordance with claim 13 wherein the latch comprises a smooth tapered exterior surface which engages the passage to deflect the arms inwardly, such that the latch arms enter and pass through the passage when the slide moves toward the other end of the fastener.

16. A child-proof flexible bag formed of tear resistant film in accordance with claim 10 wherein the puller includes a grip, the socket being formed in the grip.

17. A child-proof locking system in accordance with claim 14 wherein the first element further comprises a base, the base including a pair of coplanar legs.

18. A child-proof locking system in accordance with claim 17 wherein the first element further includes an anchor base and a web joining the base to the anchor base.

* * * * *